United States Patent [19]

DeNigris et al.

[11] 4,116,524

[45] Sep. 26, 1978

[54] TERMINAL BRIDGING ASSEMBLY

[75] Inventors: Ernest Gerard DeNigris, Colts Neck; Joseph Girardi, Edison, both of N.J.; William Edwin Ruehl, Wheeling, Ill.

[73] Assignees: Illinois Tool Works, Ill.; Bell Telephone Laboratories, Incorporated, Murray Hill, N.J.; a part interest to each

[21] Appl. No.: 811,293

[22] Filed: Jun. 29, 1977

[51] Int. Cl.[2] ..... H01R 3/00

[52] U.S. Cl. ..... 339/113 R; 174/138 F; 339/97 P; 339/198 J

[58] Field of Search ..... 339/113 R, 116 R, 116 C, 339/198 J, 20 B, 97 P; 174/92, 138 F

[56] References Cited

U.S. PATENT DOCUMENTS

| | | | |
|---|---|---|---|
| 3,234,498 | 2/1966 | Logan | 339/97 P |
| 3,255,399 | 6/1966 | Parks | 174/92 X |

*Primary Examiner*—Roy Lake
*Assistant Examiner*—DeWalden W. Jones
*Attorney, Agent, or Firm*—David H. Tannenbaum

[57] ABSTRACT

An assembly is disclosed for bridging pairs of closely spaced electrical terminals having a variety of predetermined spacings. The assembly consists of a pair of identical insulative body parts which have cavities therein for housing two identical contacts and conductive devices connected between the contacts. The contacts and the conductive devices are connected together and inserted into appropriate cavities of a first body part, whereupon the second body part is snapped together and sealed with the first body part. A cantilevered contact mount enables the contacts to deflect and mate with connector blocks having split blade-like metallic terminals of various predetermined spacings.

31 Claims, 7 Drawing Figures

TERMINAL BRIDGING ASSEMBLY

FIELD OF THE INVENTION

This invention relates to a bridging assembly for terminal connecting blocks and more particularly to a bridging assembly which can connect across terminals of various fixed spacings. An application is copending directed to the identical half concept of construction of our terminal bridging device. The identical half construction concept is the work of Mr. George M. Rapata and is the subject of U.S. Pat. application Ser. No. 810,532 filed June 27, 1977.

BACKGROUND OF THE INVENTION

Terminal connecting blocks are used extensively in the communications industry. For example, they are used in the telephone industry on distribution panels to interconnect conductors in a central office cable to conductors from the various station equipment located within a building. One type of connecting block is disclosed in U.S. Pat. No. 3,234,498 issued to A. Logan on Feb. 8, 1966. This connector block consists of a plurality of split blade-like metallic terminals arranged side-by-side in rows forming a rectangular array of terminals mounted in an electrical insulating block. The terminals are of the insulation-penetrating clip-type which penetrates the insulation and tightly clamps the conductor when a wire is inserted therein. The terminals are blade-like and are arranged side-by-side in rows so that the faces of the terminals lie in a horizontal plane. Devices for connecting between terminals horizontally separated (on the same row) can be provided by a mere inverted U-shaped bridging clip. Such a U-shaped bridging clip could be made to connect between terminals that have different horizontal spacing. A device for connecting between vertically separated terminals (same column but in adjacent rows) presents a more difficult problem, because of the shape of the terminals, requiring a more sophisticated bridging clip. Since the connecting block design as described in U.S. Pat. No. 3,234,498 is available with rows of terminals spaced vertically on 0.20 or 0.25 inch centers it would be desirable to have a bridging clip which could accommodate both types of connector blocks. The close horizontal proximity of the terminals in the connecting block requires that a bridging clip be insulated to prevent shorting between horizontally adjacent terminals. In addition, occasionally it is required to add an electrical component across the terminals of a connector block to protect the connected telephone equipment or to compensate for unusual line characteristics. The varying diameters of component lead size and the lead connecting limitations of the terminal design of the connecting block of U.S. Pat. No. 3,234,498 sometimes requires rewiring to accommodate the addition of a component across the terminals.

The prior art includes clips with a capability for connecting between terminals of a fixed spacing. Other existing connector art discloses methods of mounting electrical components into a pin which can be inserted into a pin board assembly. Thus a need exists to provide a bridging assembly which can connect across terminals of varying separation and which contains, internally, an electrical component connected across its contacts.

Accordingly, it is an object of our invention to provide a bridging assembly which can be used with connecting blocks having various vertical terminal separations.

It is another object of our invention to provide a bridging assembly which can contain electrical components mounted between the contacts and internal to the bridging assembly.

It is another object of our invention to provide an insulated bridging assembly which has a physical size which enables the placement of the bridging assembly side-by-side on adjacent terminals of the connecting block.

It is another object of our invention to provide for a visual monitor capability in the bridging assembly.

It is another object of our invention to make a bridging assembly which connects to the terminals of the connecting block applying a minimal amount of lateral force on the terminals.

It is another object of our invention to make a bridging assembly which makes good electrical and a firm mechanical connection to wired or unwired terminals of the connecting block.

It is a further object of our invention to develop an economical bridging assembly.

SUMMARY OF THE INVENTION

We have designed a terminal bridging assembly which meets the desired objectives. The disclosed bridging assembly is comprised of five parts including a pair of identical insulative body parts, a pair of identical electrical contacts and a conductive device. The body parts are designed with two contact ports that open to the bottom surface of the body and into which the electrical contacts are mounted. The body parts also have a centrally located "T"-shaped cavity with a narrow passageway at each end connecting it to the contact ports. These passageways have a depth that is contoured to mate with the trapezoidal positioning notches in the contact and are as wide as the thickness of the contact. The "T"-shaped cavity is used to house an electrical component placed vertically in the component cavity with its leads bent to fit into the horizontal or connection cavity. Electrical connection to the component is accomplished by pressing each lead of the component into a connection notch in each contact.

The identical contacts are formed from a strip of conductive material and have at least two conductive notches and two trapezoidal positioning notches in one end with a double reversing fold formed in the other end. The shape of the contact resembles the small letter "*h*". The double reversing fold forms a receptor which can deflect in both directions while still enabling a good electrical and a firm mechanical connection to a terminal. The positions of the contacts is such that connection to a connecting block with terminals spaced 0.20 inches apart requires the contacts to be deflected inwardly while connection to a connecting block with terminals spaced 0.25 inches apart requires the contacts to be deflected outwardly. The receptor opening of the contacts is made smaller than the size of the terminal to which it connects and is beveled to facilitate the deflecting of the contact.

After snapping each lead of the electrical component into a connective notch of each contact, the contacts and component are placed into their respective cavities of the body half. The contacts are positioned such that the trapezoidal notches mate with the contour of the body passageway such that one end of the contact is fixed in a cantilevered manner. Once the parts are in place the top body half can be placed over the bottom body half and snapped together. If desirable an additional mechanical process can be used to permanently bond the housing parts together.

The use of different body parts will enable the mounting of a visual indicator within the bridging assembly. The body for such an indicator requires another cavity with a port opening on the top surface of the body. A ledge is placed across the opening at the base of the neck to mechanically support the visual device when it is mounted in the bridging assembly.

Accordingly, it is one feature of our invention to provide a bridging assembly which can be used with connector blocks having various terminal separations.

Another feature of our invention is to provide a capability to mount electrical components within the housing and connected across its contacts.

Another feature of our invention is to provide an insulated bridging assembly with dimensions enabling the placement of the assembly side-by-side on adjacent terminals of the connecting block.

Another feature of our invention is to provide a bridging assembly with a visual indicator mounted within the assembly.

Another feature of our invention is the use of a continuously formed contact with a deflection means and a frictional electrical connective means which exerts minimal lateral force on the terminals yet maintains good electrical contact and rigid mechanical support for the bridging assembly.

Another feature of our invention is to use identical component parts which are simple in construction and easily assembled to minimize the cost of the bridging assembly.

DESCRIPTION OF THE DRAWINGS

The operation and utilization of the present invention will be more apparent from the following description taken in conjunction with the drawings in which.

DETAILED DESCRIPTION

Figure 1:
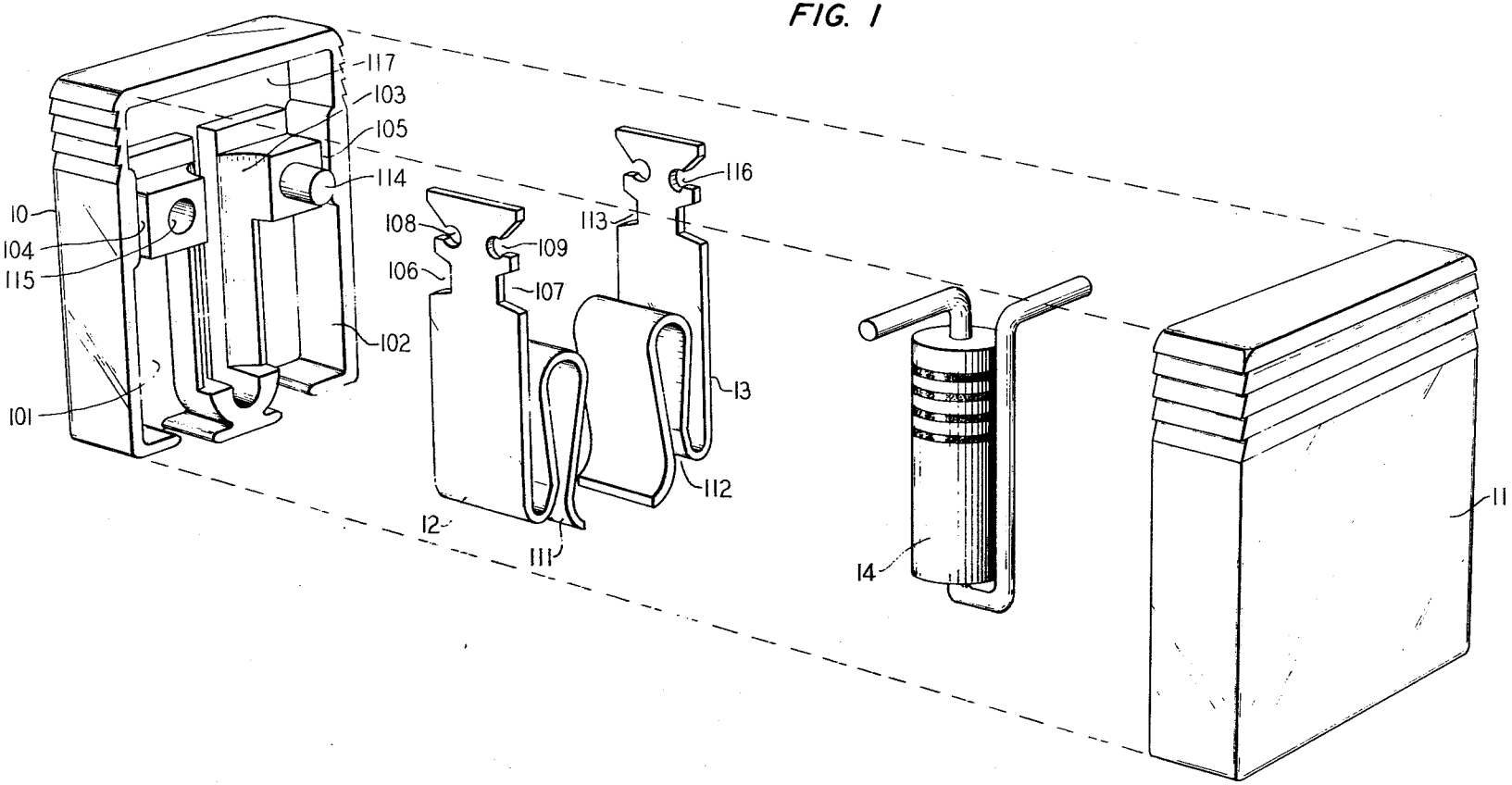
FIG. 1 shows an exploded view of the bridging assembly.

IN FIG. 1 there is shown an exploded view of a bridging assembly. Each body half 10 and 11 of the bridging assembly is identical and is formed of insulating material with multiple cavities therein. Two contact ports 101 and 102 open to the bottom surface of body parts 10 and 11. The body parts also have a centrally located "T" shaped cavity comprised of a vertical component cavity 103 and a horizontal connection cavity 117 with a narrow passageway (104 and 105) at each end connecting it to contact ports 101 and 102. Passageways 104 and 105 have a depth that is contoured to mate with trapezoidal positioning notches (106 and 113) in contacts 12 and 13 and have a width equal to the thickness of contacts 12 and 13. The length of passageways 104 and 105 prevent connection notches 108 and 110 in contacts 11 and 12 from moving when the contacts are subjected to bending forces. Contacts 11 and 12 are thus cantilever mounted in these passageways of the body parts. The component cavity 103 is used to house electrical component 14 placed vertically in the cavity with its leads bent to fit into the connection cavity 117. Electrical connection is accomplished by pressing the leads of component 14 into the slightly smaller opening of connection notches 108 and 110 of contacts 12 and 13. Connective notches 109 and 116 can be made either larger or smaller than connective notches 108 and 110 thereby enabling contact to components with leads of various diameters. The disclosed embodiment allows the use of multiple passive or active components within the bridging assembly. The bridging assembly having enclosed components can be used as a protective electrical device or telephone line compensating device as discussed earlier in the specification.

Each identical contact 12 and 13 is formed from a strip of conductive material having at least two connective notches 108 and 109 and two trapezoidal positioning notches 106 and 107 in one end with a double reversing fold at the other end. The shape of contact 12 resembles the small letter "*h*."

Figure 2C:
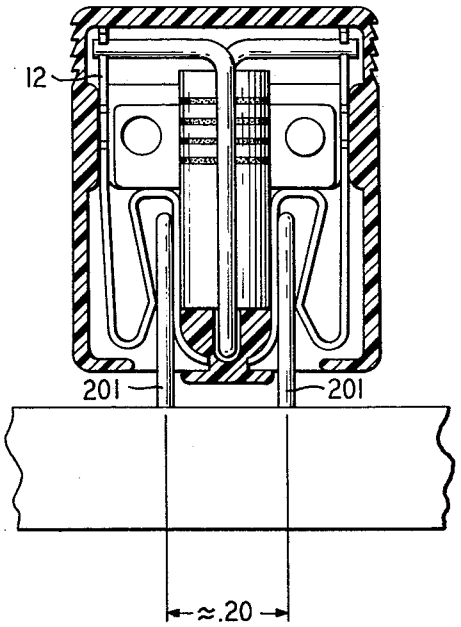
FIG. 2 shows the flexibility of the contact used in the bridging assembly.
Figure 2B:
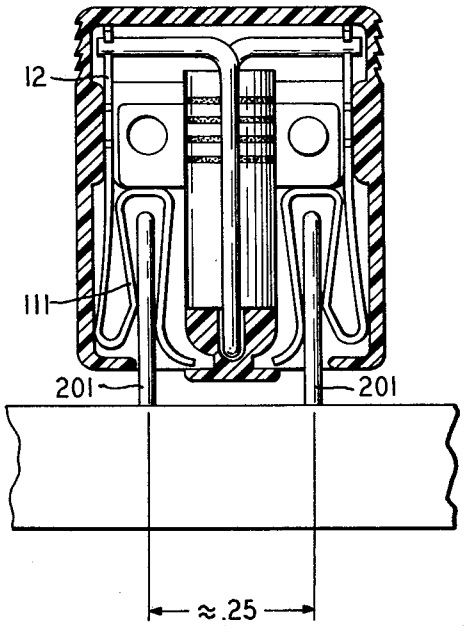
Figure 2A:
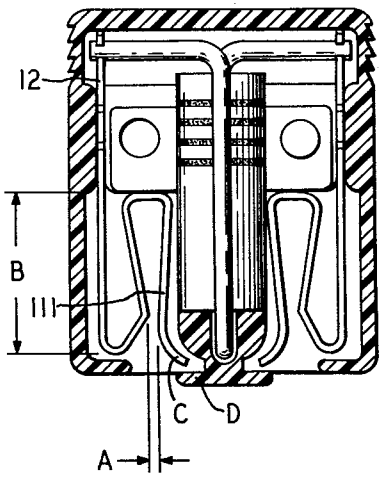

Referring to FIG. 2A the double reversing fold of contact 12 forms a receptor 111 with an opening (A) which can deflect in two directions to connect to terminals with different separations. As shown in FIG. 2B the size and shape of receptor 111 enables contact to both sides of terminal 201 providing a good electrical as well as a firm mechanical connection. Opening (A) which is smaller than the size of the terminal to which it connects and thus the contact connection force between receptor 111 and and terminal 201 is the result of forcing the opening (A) to accommodate terminal 201, rather than any force resulting from the contact having been deflected. This contact connection force is substantially independent of the deflection force that exists when the contact is deflected to connect to the terminal. The funnel shaped beveled opening of receptor 111 provides the surfaces which develop the contact deflecting force when engaging the terminal to which the contact is to connect. Dimension B of FIG. 2A is the length of the cantilever which deflects to accommodate terminals with separations of approximately 0.20 (FIG. 2C) through 0.25 inches (FIG. 2B). The contact design results in a nearly uniform force required to mate with the bridging assembly with terminals of various separations. When removing the bridging assembly from the terminals, edge C (FIG. 2A) of the contact engages lip D of the housing to help release the contact from the terminal.

Contacts 12 and 13 are made of stainless steel which provide the required contact seal with solder dipped terminals which are in prevalent use in connector blocks used by the telephone industry. The use of stainless steel as a material reduces the cost of the contacts without significantly enhancing contact corrosion problems. Other materials such as brass or phosphor-bronze can be used which would enable crimping and soldering of the component leads to the contact. Contacts made with such materials may increase the cost of the contacts and the assembly cost of the bridging clip assembly.

Referring again to FIG. 1 after the leads of component 14 are snapped into connective notches 108 and 110 of the respective contacts 12 and 13 the parts are placed into their respective cavities of body half 10. Contacts 12 and 13 are positioned such that trapezoidal notches 106 and 113 engage with the mating contour in passageways 104 and 105 of body half 10. Body half 10 contains an aligning post 114 and hole 115 which mates with the associated post and hole of body half 11. To complete the assembly body half 11 is placed over body half 10 and then snapped together. Once body halves 11 and 12 are snapped together additional well known processes can be used to permanently bond the body parts together.

Figure 4:
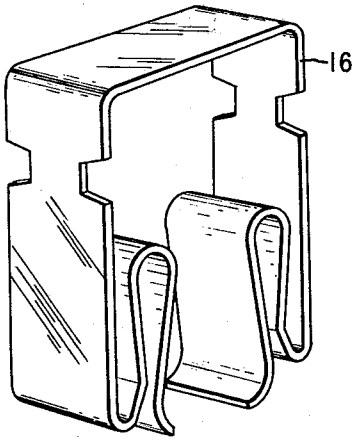
FIG. 4 shows the contact required for a shorting bridging assembly.

The bridging assembly of FIG. 1 can be used to short adjacent terminals by using a solid wire conductor connected between contacts 12 and 13. A shorting bridging assembly can also be constructed, as shown in FIG. 4, by using formed contact 16 instead of using solid wire conductor between contacts 12 and 13. Formed contact 16 is one continuous conductor with a contact formed at each end and trapezoidal positioning notches along its length. Assembly of this shorting bridging assembly is accomplished in the same manner as previously described.

Figure 3:
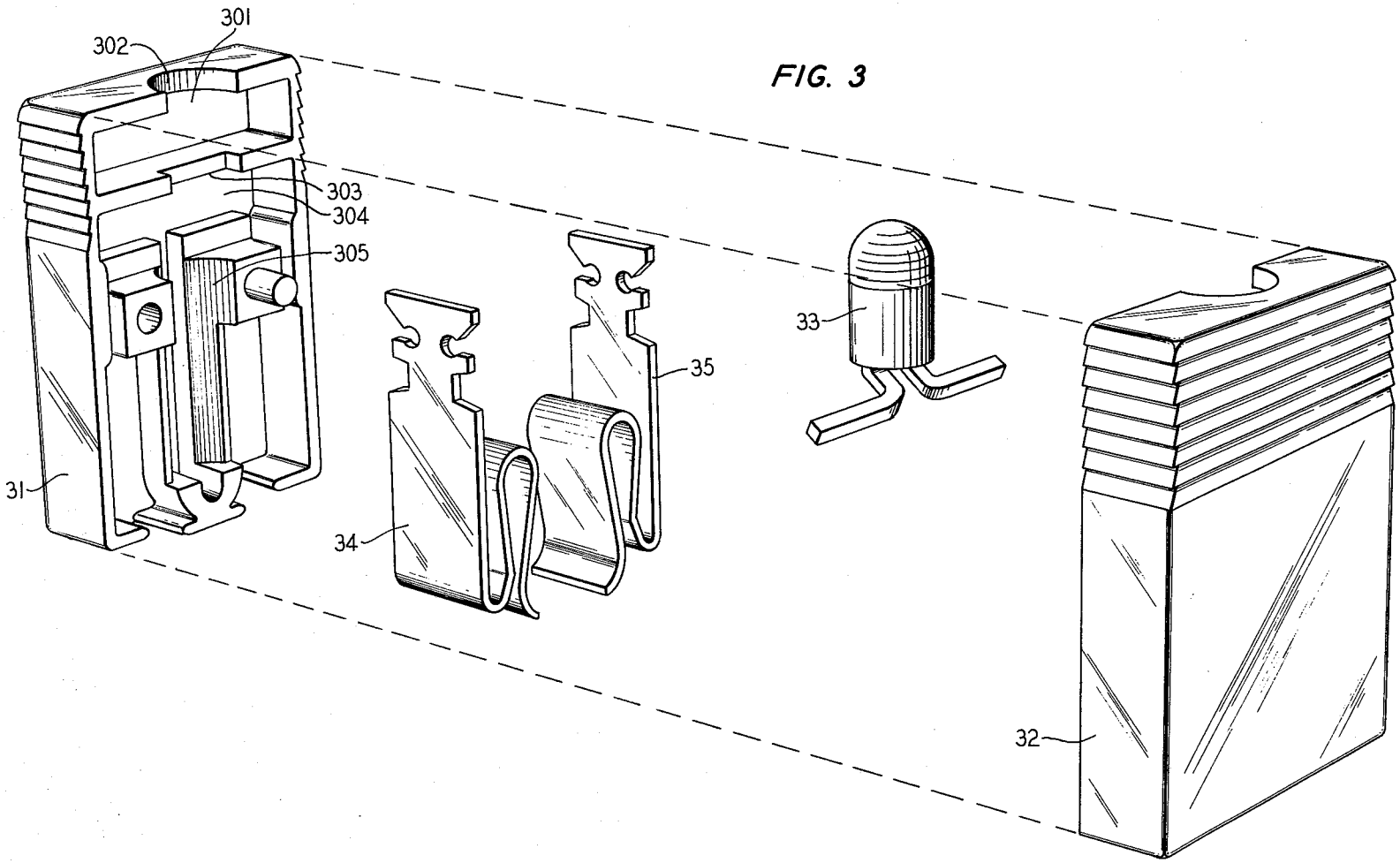
FIG. 3 shows the visual indicator embodiment of the bridging assembly.

As depicted in FIG. 3 the use of other body halves 31 and 32 will enable the mounting of visual indicator 33 which in, our embodiment, is a light-emitting diode. Each body part 31 and 32 contains a cavity 301 which opens through port 302 to the top surface of the body. Ledge 303 across the base of cavity 301 is used to support visual indicator 33 such that it can be viewed when the unit is assembled. The leads of the visual device extend into connection cavity 304 to connect to contacts 34 and 35. The connective notches of contacts 34 and 35 are made smaller than the diagonal cross-section dimension of the leads of visual indicator 33 thus ensuring a good electrical connection between each lead and contact. Contacts 34 and 35 of FIG. 3 can be identical to contacts 12 and 13 of FIG. 1 if the lead size of the associated components can fit into one of the various sized connective notches. Visual indicator 33 can be a light-emitting diode or other device for displaying visually signals appearing across contacts 34 and 35. Where applications require, additional components can be mounted in component cavity 305.

In addition, a wire cable can be extended through port 302 and each wire of the cable can be terminated on contacts 34 and 35 thus forming a cable connector.

Figure 5:
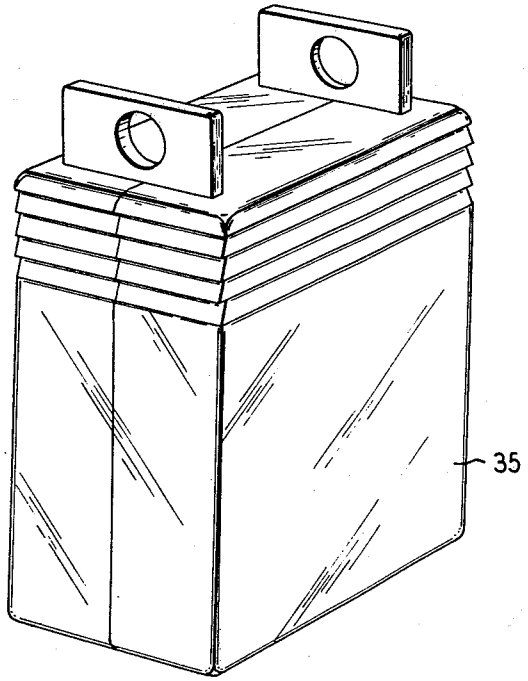
FIG. 5 shows a monitor bridging assembly.

Shown in FIG. 5 is another embodiment illustrating an assembled bridging clip with external terminals for monitoring purposes.

The discloded embodiments are merely illustrative of our invention. These embodiments may be subject to many modifications by persons skilled in the art without deviating from the spirit or essential characteristic thereof.

What is claimed is:

1. An assembly for bridging closely spaced electrical terminals of connector blocks having a variety of terminal spacings the assembly comprising:

a housing constructed of an electrically insulative material, said housing comprising, a plurality of spaced ports having one end opening to the outer surface of said housing, a component cavity disposed between said ports, a connection cavity adjacent to the closed end of said ports and communicating with one end of said component cavity, a passageway between each said closed end of each said port and said connection cavity;

at least one electrical element located in said component cavity having at least two leads formed to enable said leads to fit into said connection cavity;

first and second electrical contacts adapted to fit within said ports, each said electrical contact including, means for fixing a first end of each said contact in said passageway of said housing such that the tip of said first end extends into said connection cavity while enabling the free movement of a second end of each said contact, means for receiving in electrical contact at said tip of first end of said first contact a first lead of said element, means for receiving in electrical contact at said tip of first end of said second contact a second lead of said element, and means for allowing deflection of each said contact by providing contact surfaces which will cause each said contact to move in a first direction to align for a connection with a terminal of a terminal pair having a first spacing and move in a second direction to align for a connection with a terminal of a terminal pair having a second spacing when said terminals enter said ports.

2. The invention of claim 1 wherein each said contact contains clamping means for providing a connection force which is substantially independent of the resulting lateral force derived from said deflecting means.

3. The invention of claim 2 wherein said fixing means includes a notch in the longitudinal edge of each said contact which locks with a contour in associated said passageway.

4. The invention of claim 3 wherein said clamping means is formed from a double reversing fold in said second end of each said contact which provides a clip type connection to said terminals.

5. The invention of claim 4 wherein said deflecting means is created in each said contact by forming a funnel shaped entrance to said clamping means.

6. The invention of claim 1 where said housing is adapted for connection to regularly spaced terminals arranged on connector blocks and wherein said housing is substantially rectangular and provides a low profile when bridged across said terminals of said connector block.

7. The invention of claim 6 where said housing dimension allows for side-by-side stacking of said assembly with said terminals of said connector block having a side-by-side separation of approximately 0.3 inches.

8. The invention of claim 7 where said housing dimension allows for stacking said assembly one-over-another with said terminals of said connector block having a face-to-face separation of approximately 0.25 inches.

9. An assembly for bridging closely spaced electrical terminals of connector blocks having a variety of terminal spacings the assembly comprising:

a housing constructed of an electrically insulative material, said housing comprising, a plurality of spaced ports having one end opening to the outer surface of said housing, a connection cavity adjacent to the closed end of said ports, a passageway between each said closed end of each said port and said connection cavity;

a single continuous conductor means with a contact at each end, adapted to fit within said connection cavity and said ports, said conductor means including, means for fixing said conductor means in said passageway of said housing, such that said contact at each end is free to move, means for allowing deflection of each said contact by providing contact surfaces which will cause each said contact to move in a first direction to align for a connection with a terminal of a terminal pair having a first spacing and move in a second direction to align for a connection with a terminal of a terminal pair having a second spacing when said terminals enter said ports.

10. The invention of claim 9 wherein each said contact contains clamping means for providing a connection force which is substantially independent of the resulting lateral force derived from said deflecting means.

11. The invention of claim 10 wherein said fixing means includes a notch in the longitudinal edge of said conductor means which locks with a contour in associated said passageway.

12. The invention of claim 11 wherein said clamping means is formed from a double reversing fold in one end of said conductor means which provides a clip type connection to said terminal.

13. The invention of claim 12 wherein said deflecting means is created in said conductor means by forming a funnel shaped entrance to said clamping means.

14. The invention of claim 9 where said housing is adapted for connection to regularly spaced terminals arranged on connector blocks and wherein said housing is substantially rectangular and provides a low profile when bridged across said terminals of said connector block.

15. The invention of claim 14 where said housing dimension allows for side-by-side stacking of said assembly with said terminals of said connector block having a side-by-side separation of approximately 0.3 inches.

16. The invention of claim 15 where said housing dimension allows for stacking said assembly one-over-another with said terminals of said connector block having a face-to-face separation of approximately 0.25 inches.

17. An assembly for bridging closely spaced electrical terminals of a connector block having a variety of terminal spacings, the assembly comprising:

a housing constructed of an electrically insulative material, said housing comprising, first and second spaced ports having one end opening to a first outer surface of said housing, a third port opening to a second outer surface of said housing, a component cavity disposed between said first and second ports, a connection cavity adjacent to a closed end of said ports and communicating with one end of said component cavity, a passageway associated with and between each said closed end of each said port and said connection cavity;

a visual indicator element located in said third port opening to said second outer surface of said housing, said indicator element having at least two leads formed to enable said leads to fit into said connection cavity;

first and second electrical contacts adapted to fit within said first and second spaced ports respectively, each said electrical contact including, means for fixing a first end of each said contact in said passageway associated with said port containing said contact such that the tip of said first end extends into said connection cavity while enabling the free movement of a second end of each said contact within said port, means for receiving in electrical contact at said tip of first end of said first contact a first lead of said element, means for receiving in electrical contact at said tip of first end of said second contact a second lead of said element, and means for allowing deflection of each said contact by providing contact surfaces which will cause each said contact to move in a first direction to align for a connection with a terminal of a terminal pair having a first spacing and move in a second direction to align for a connection with a terminal of a terminal pair having a second spacing when said terminals enter said ports.

18. The invention of claim 17 wherein each said contact contains clamping means for providing a connection force which is substantially independent of the resulting lateral force derived from said deflecting means.

19. The invention of claim 18 wherein said fixing means includes a notch in the longitudinal edge of each said contact which locks with a contour in associated said passageway.

20. The invention of claim 19 wherein said clamping means is formed from a double reversing fold in said second end of each said contact which provides a clip type connection to said terminals.

21. The invention of claim 20 wherein said deflecting means is created in each said contact by forming a funnel shaped entrance to said clamping means.

22. The invention of claim 21 where said visual indicator device is a light-emitting diode.

23. The invention of claim 22 where said closed end of said third port contains a ledge to provide a locking surface between base of said visual indicator element and said formed leads of said light-emitting diode.

24. The invention of claim 17 where said housing is adapted for connection to regularly spaced terminals arranged on connector blocks and wherein said housing is substantially rectangular and provides a low profile when bridged across said terminals of said connector block.

25. The invention of claim 24 where said housing dimension allows for side-by-side stacking of said assembly with said terminals of said connector block having a side-by-side separation of approximately 0.3 inches.

26. The invention of claim 25 where said housing dimension allows for stacking said assembly one-over-another with said terminals of said connector block having a face-to-face separation of approximately 0.25 inches.

27. A protective electrical device adapted for use with electrical wiring terminal blocks having adjacently positioned elongated metallic terminal means, said device including dielectric body means, multiple contact means, and an electrical component means connected to said contact means, said body means consisting of a pair of body portions including a plurality of positioning means for separating and retaining said contact and component means in predetermined relationship as if in spaced chambers, a transverse chamber adjacent one end of said body means communicating with said contact and component means positions, and electrical connection means transversing said transverse chamber between said contact and component means, said body means further including spaced port means opening through said body means, said contact means are two in number, positioning means in said chambers for cooperative retention of said contacts that fixes one end of each of said contacts and permits bilateral adjustability of each of the opposite ends of said contact to align for connection to a variety of predetermined spacings of said terminal means entering through said spaced port means of said body means.

28. A device of the type claimed in claim 27 wherein each of said contacts is provided with cooperative means adjacent said one end complementary to shoulder means in each said chamber adapted to locate and retain said contact in fixed axial relation to said body.

29. A device of the type claimed in claim 28 wherein each of said contacts is formed from a flat strip of sheet material including a flat tail portion which adjacent one end carries connector means for engaging said electrical connection and said tail portion further carrying said cooperative means, a first resilient reversely bent portion connected at the opposite end of said tail portion and extending away from and thence towards said tail portion, one end and a second reversely bent portion extending in the same axial direction as said opposite end and forming an adjustable open throat between said retaining means adapted for cooperation between the free end of said second portion and said body means, said retaining means including slot means in said body adjacent to said port means with the free end of said second portion adjustably captured in said slot means whereby said open throat presents a laterally adjustable smooth surface for introduction and capture of said terminal means.

30. A device of the type claimed in claim 27 wherein said body means is substantially rectangular with said transverse chamber extending along one narrow end and with said spaced ports opening through the opposite end, a centrally disposed substantially cylindrical positioning means adapted to accommodate an elongated complementary cylindrical electrical component, chamber means positioned laterally on opposite sides of the axis of said cylindrical positioning means for accommodating said contact means and communicating with said port means, slot means communicating between said contact chambers and said transverse chamber, lead accommodating means associated with said cylindrical positioning means to provide access for electrical connections from said electrical component through said transverse chamber to said contacts whereby a circuit can be established, said body means further including secondary port means opening through a side other than the side having the contact port means, said secondary port means provided with strain relief means and capable of accommodating and permitting viewing of a light emitting component.

31. A device of the type claimed in claim 30 wherein said body secondary port means opening through a side other than the side having the contact port means includes an axially outwardly extending shield surrounding said secondary port means which is substantially co-axial with said cylindrical positioning means, abutment means positioned within said shield and adapted to serve as axial locating means for said light emitting component and to position and restrain the electrical connections as they extend into said transverse chamber.

* * * * *